United States Patent [19]

Nelson

[11] Patent Number: 4,706,611

[45] Date of Patent: Nov. 17, 1987

[54] METHODS AND APPARATUS FOR PRODUCING STEAM WITHOUT A BOILER

[76] Inventor: Bill W. Nelson, P.O. Box 872969, Wasilla, Ak. 99687

[21] Appl. No.: 894,920

[22] Filed: Aug. 8, 1986

[51] Int. Cl.[4] ..... F22B 37/00

[52] U.S. Cl. ..... 122/5.5 A; 122/41

[58] Field of Search ..... 60/674; 122/5.5 A, 40, 122/41

[56] References Cited

U.S. PATENT DOCUMENTS

| | | | |
|---|---|---|---|
| 467,835 | 1/1892 | Romkey | 60/39.23 |
| 1,154,131 | 9/1915 | Sands | 60/39.26 |
| 2,759,328 | 8/1956 | Cockrell | 122/5.5 A |
| 4,382,771 | 5/1983 | Carr | 431/158 |
| 4,604,988 | 8/1986 | Rao | 122/5.5 A |

FOREIGN PATENT DOCUMENTS

| | | | |
|---|---|---|---|
| 7555 | of 1927 | Australia . | |
| 190535 | 10/1907 | Fed. Rep. of Germany . | |
| 822494 | 12/1937 | France . | |
| 1002632 | 3/1952 | France | 122/5.5 A |

*Primary Examiner*—Stephen F. Husar

*Attorney, Agent, or Firm*—Burns, Doane, Swecker & Mathis

[57] ABSTRACT

Steam is produced by introducing compressed air into one end of a vessel, heating the air, and inducing a continuous swirling motion of the air as it travels from an inlet toward an outlet. A heated deflector plate is disposed in the vessel upstream of the outlet and is opened at its outer periphery to conduct the swirling air. Water is sprayed against a backside of the heated deflector plate such that the water becomes vaporized and entrained in the air flow to exit as steam through the outlet. Additionally or alternatively, a pair of outlets can be provided, one situated at a radially outer portion of the vessel and another situated centrally of the vessel. Hotter steam is exited through the outer outlet and cooler steam is exited through the center outlet.

22 Claims, 7 Drawing Figures

120
102
106
120
106
116
108
122
118
106
112
114
110
106
116
126
100
106
104
124
126

Fig. 6
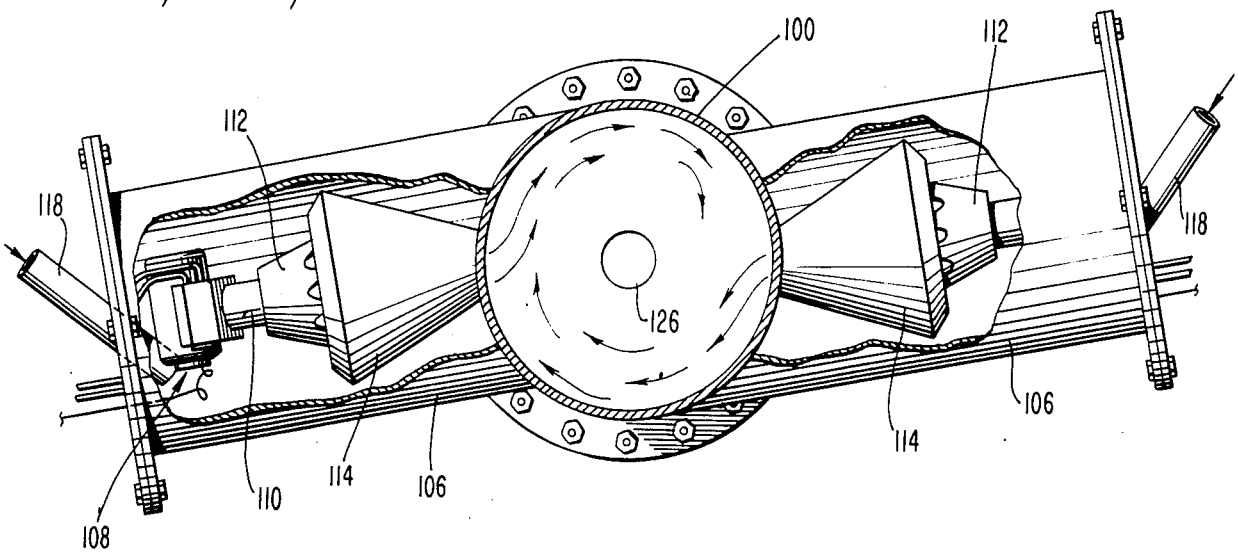
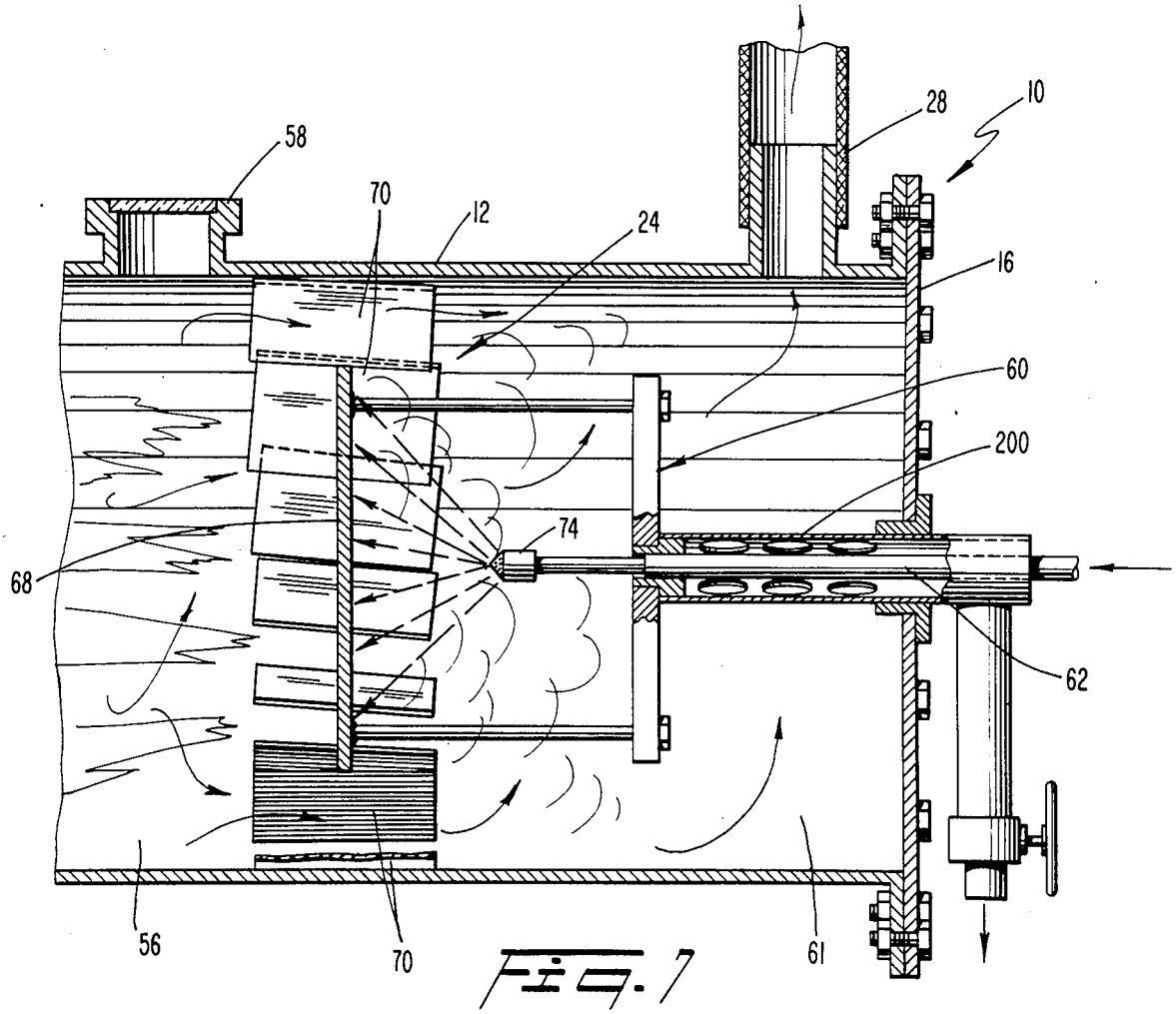
Fig. 7

METHODS AND APPARATUS FOR PRODUCING STEAM WITHOUT A BOILER

BACKGROUND AND OBJECTS OF THE INVENTION

The present invention relates to methods and apparatus for producing steam.

Steam can be effectively used for the thawing and cleaning of water lines, sewer lines, and road culverts among other objects. Steam producing apparatuses which can be transported to areas where steam is needed are thus highly beneficial, especially in colder climates where the need for steam as a thawing agent is particularly evident.

Steam producing apparatuses heretofore employed have included a boiler and a system of coils and tubes. Such apparatuses are relatively slow starting since a large amount of water must be heated before steam is produced. Also, such apparatuses can be subject to freezing, leaks, warps, and melt downs and can result in sedimentary deposits and mineralization which must be dealt with.

It is, therefore, an object of the present invention to minimize or obviate problems of the types discussed above.

Another object is to provide steam producing methods and apparatus which avoid the need to preheat a supply of water.

A further object is to provide such methods and apparatus which avoid the need for a network of coils and tubes.

Yet another object is to provide such methods and apparatus which involve fewer components and are less expensive to make and maintain.

SUMMARY OF THE INVENTION

These objects are achieved by the present invention which relates to methods and apparatus for producing steam. An apparatus aspect of the present invention comprises a vessel defining a longitudinal axis and opposing front and rear longitudinal ends. An inlet is disposed adjacent the front end and an outlet is disposed adjacent the rear end. A conduit introduces compressed air into the inlet such that the air travels from the inlet toward the outlet. The air is caused to swirl continuously as it travels. A heater heats the air. A sprayer sprays water into the heated swirling air such that the water becomes vaporized and entrained in the air flow and exits as steam through the outlet.

Preferably, a deflector plate is disposed in the vessel upstream of the outlet and sprayer and is open at its outer periphery to permit the swirling heated air to flow therethrough. The heater also heats the deflector plate. The sprayer sprays the water against a backside of the deflector plate so that the water is vaporized upon striking the deflector plate and is deflected rearwardly into the air flow.

Preferably, the outlet is disposed on a side wall of the vessel, and an additional outlet extends from a longitudinal center of the vessel such that hot steam exits through the side outlet, and cooler steam exits through the center outlet.

Another apparatus aspect of the present invention involves a vessel defining a longitudinal axis having an inlet and first and second outlets spaced longitudinally rearwardly from the inlet. A conduit introduces compressed air through the inlet such that the air travels through the inlet toward the outlets. The air is heated and is induced to swirl. A conduit introduces water into the vessel which vaporizes in response to contacting the heated swirling air to form a swirling steam flow characterized by hotter steam at an outer periphery of the steam flow and cooler steam at the center of the steam flow. The first outlet is disposed at an outer periphery of the vessel to exhaust the hotter steam, and the second outlet is disposed centrally of the vessel to exhaust the cooler steam.

The present invention also involves method aspects of the above-described apparatuses.

THE DRAWINGS

The objects and advantages of the invention will become apparent from the following detailed description of preferred embodiments thereof in connection with the accompanying drawings in which like numerals designate like elements, and in which:

FIG. 6 is a plan view, partially broken away, of the embodiment depicted in FIG. 6; and FIG. 7 is a fragmentary longitudinal sectional view of a downstream end of a further embodiment of the present invention.

DETAILED DESCRIPTION OF PREFERRED EMBODIMENTS OF THE INVENTION

Figure 1:
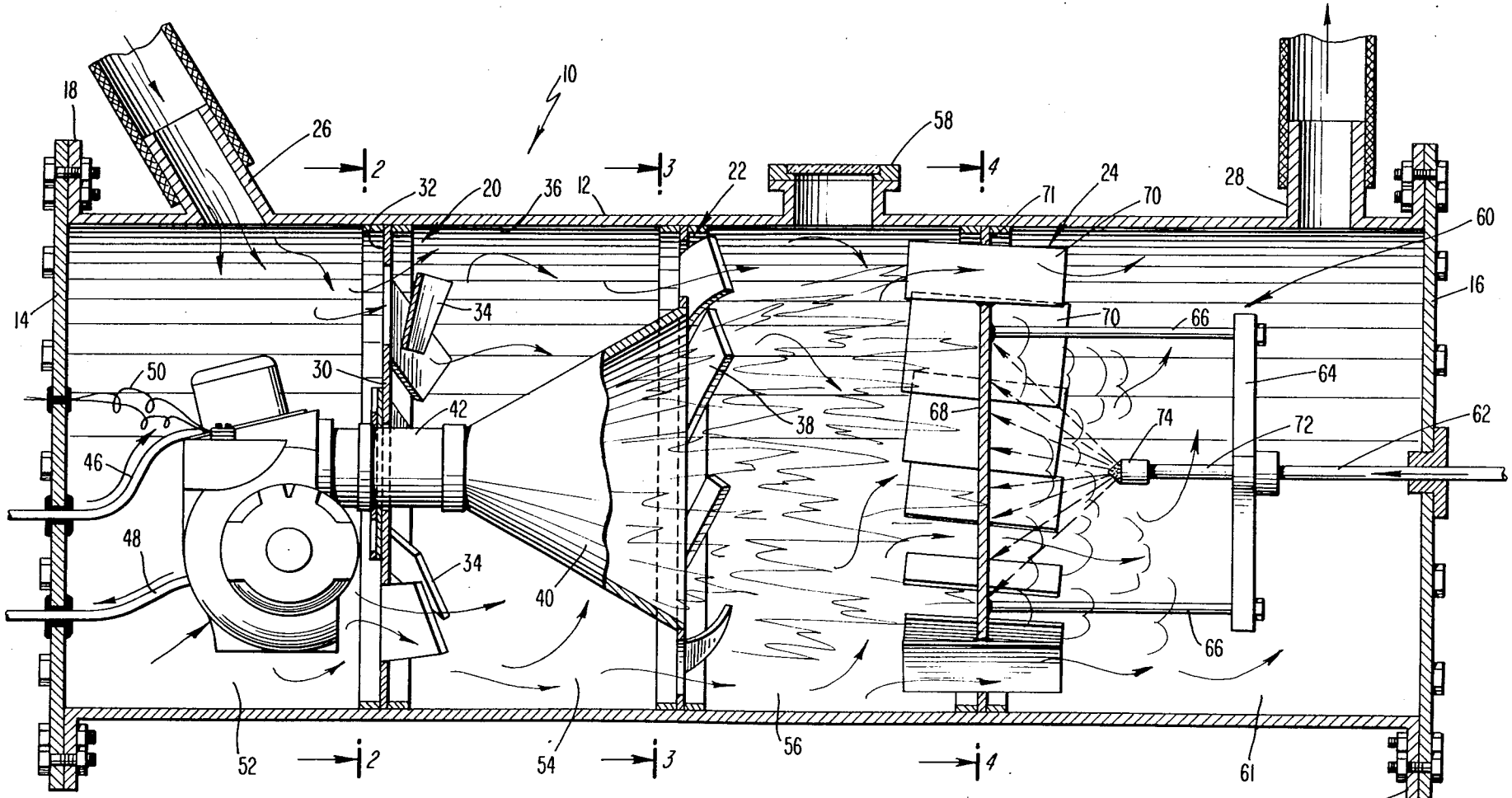
FIG. 1 is a longitudinal sectional view taken through a vessel according to one aspect of the present invention.
Figure 2:
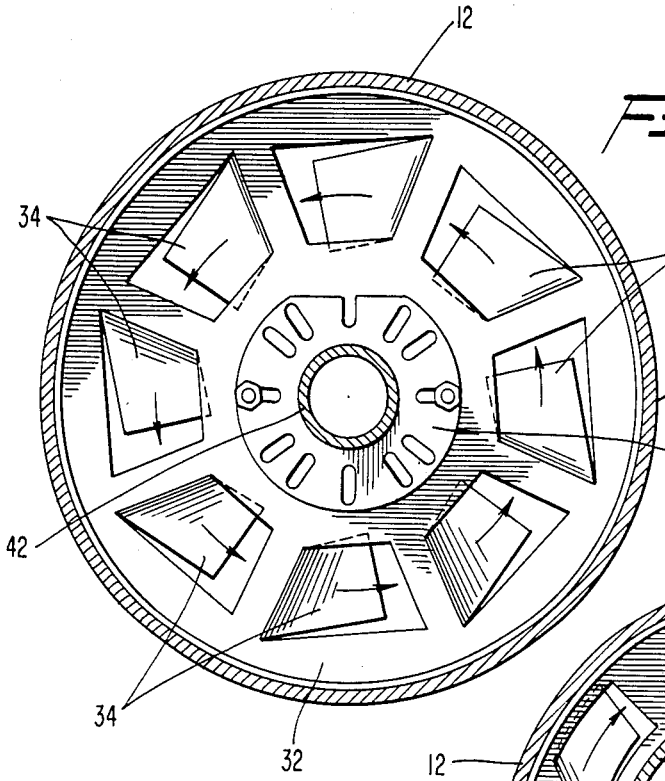
FIG. 2 is a cross-sectional view taken along line 2—2 of FIG. 1.
Figure 3:
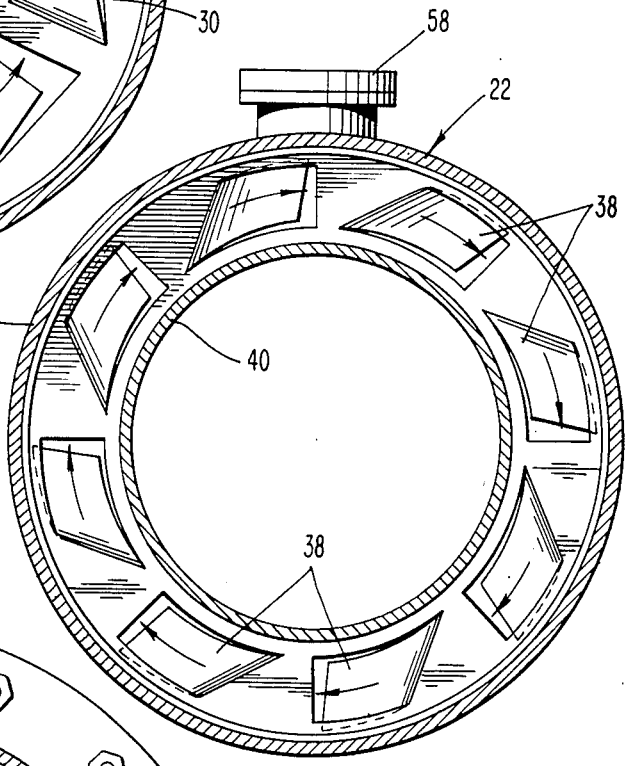
FIG. 3 is a cross-sectional view taken along line 3—3 of FIG. 1.
Figure 4:
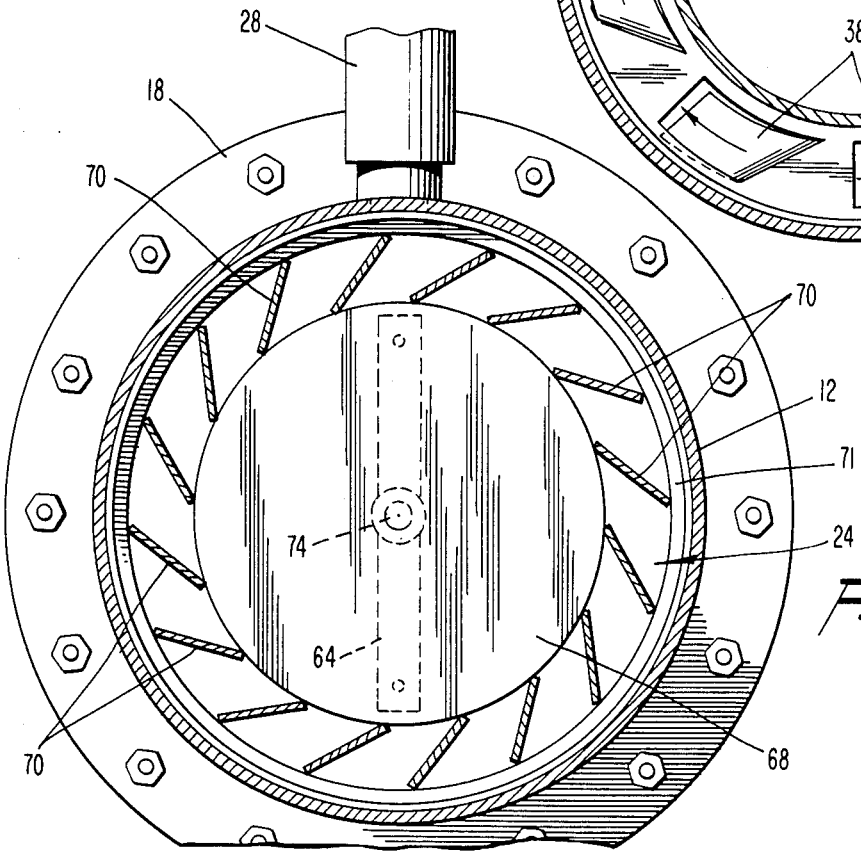
FIG. 4 is a cross-sectional view taken along line 4—4 of FIG. 1.

A steam producing apparatus 10 according to the present invention is depicted in FIGS. 1–4 and includes a horizontal cylindrical vessel 12 which is closed off at its ends by front and rear end plates 14, 16, the plates being bolted to end flanges 18 of the vessel. The interior of the vessel is partitioned into a plurality of chambers by a series of turbulator plates 20, 22, 24 which are spaced apart in the longitudinal direction of the vessel. Disposed at one end, i.e., an inlet end, of the vessel is an air inlet tube 26, and disposed at the other end, i.e., an outlet end, is a steam outlet tube 28. The air inlet tube 26 introduces a flow of pressurized air which travels longitudinally through the vessel and exits in the form of steam through the outlet tube 28. As the air travels through the vessel, it is induced to swirl in one direction by the turbulator plates 20, 22, 24.

A first of the turbulator plates 20 comprises a solid center section 30, an annular outer rim 32, and a peripheral array of circumferentially spaced radial vanes arranged to conduct and deflect the air flow tangentially to impart a swirling motion to the air as it travels longitudinally through the vessel. The outer rim 32 is affixed to an inner surface 36 of the vessel to render the plate 30 stationary.

The second turbulator plate 22 is of a similar construction as the first turbulator plate 20 in that it includes an outer rim 37 affixed to the vessel and vanes 38 arranged to impart a swirling motion to the air in the same direction as the swirling motion imparted by the vanes 34 of the first turbulator plate 20.

Attached to a center opening in the second turbulator plate is a large end of a frusto-conical flame shield 40. The flame shield is attached to a cylindrical tube 42 which passes through a center opening of the first turbulator plate and defines the outlet of a burner 44. The burner 44 can comprise any conventional burner such as a standard gun type two-stage oil furnace burner. Fuel inlet and outlet conduits 46, 48 communicate with a combustion chamber of the burner, and combustion is effected by a spark supplied by an electric conduit 50. The burner 44 is supported by the first turbulator plate 20 within a first chamber 52 situated between the end plate 14 and the first turbulator plate. This is the chamber to which the pressurized air is delivered via the inlet tube 26 from a suitable air compressor.

Flame from the burner passes through the cylindrical tube 42 and the flame shield 40 which are situated within a second chamber 54 delineated by the first and second turbulator plates. The flame exits the flame shield within a third chamber 56 situated between the second and third turbulator plates 22, 24. In that chamber 56 the flame contacts the swirling air emanating from the second turbulator plate 22 so as to intensively heat the air. A thorough and uniform heating of the air is promoted by the swirling action of the air as it contacts the flame. Since the air is traveling tangentially as well as longitudinally, it contacts the flame for a more extended period and is more intensively heated.

A sight glass 58 is disposed in the vessel to permit the condition of the flame to be monitored from outside the vessel.

The third turbulator plate 24 has a pipe carrier 60 connected thereto which, in turn, carries a water pipe 62 entering a fourth chamber 61. The carrier 60 includes an arm 64 from which a pair of rods 66 extends in a longitudinally forward direction. The rods are connected to an impervious center hub or deflector plate 68 of the third turbulator plate 24. Vanes 70 are mounted on the outer edge of the hub 68 and are oriented to maintain the swirling action of the air flowing rearwardly therethrough. That is, the vanes keep the air swirling in the same direction as induced by the other turbulator plates. A ring 71 connects the third turbulator plate to the inner surface 36 of the vessel 12.

The water tube 72 passes through the arm 64 and terminates in a spray nozzle 74 aimed at a backside of the deflector plate 68.

Since the deflector plate has been heated intensively by the flame emanating from the flame shield 40, the water will become instantly vaporized upon striking the deflector plate 68. The vapor is deflected rearwardly and outwardly and becomes entrained within the swirling flow of heated air passing through the vanes 70 of the third turbulator plate 24 to complete the vaporization. The resulting steam flow exits through the steam outlet 28 and can be utilized for appropriate thawing and cleaning operations.

It will be appreciated that steam can be produced virtually instantly upon start-up of the system since there is no need to await the heating-up of a supply of water. The absence of a network of coils and tubes for conducting the water minimizes problems associated with freezing and leakage commonly associated with conventional boiler types of steam generating apparatuses.

Figure 5:
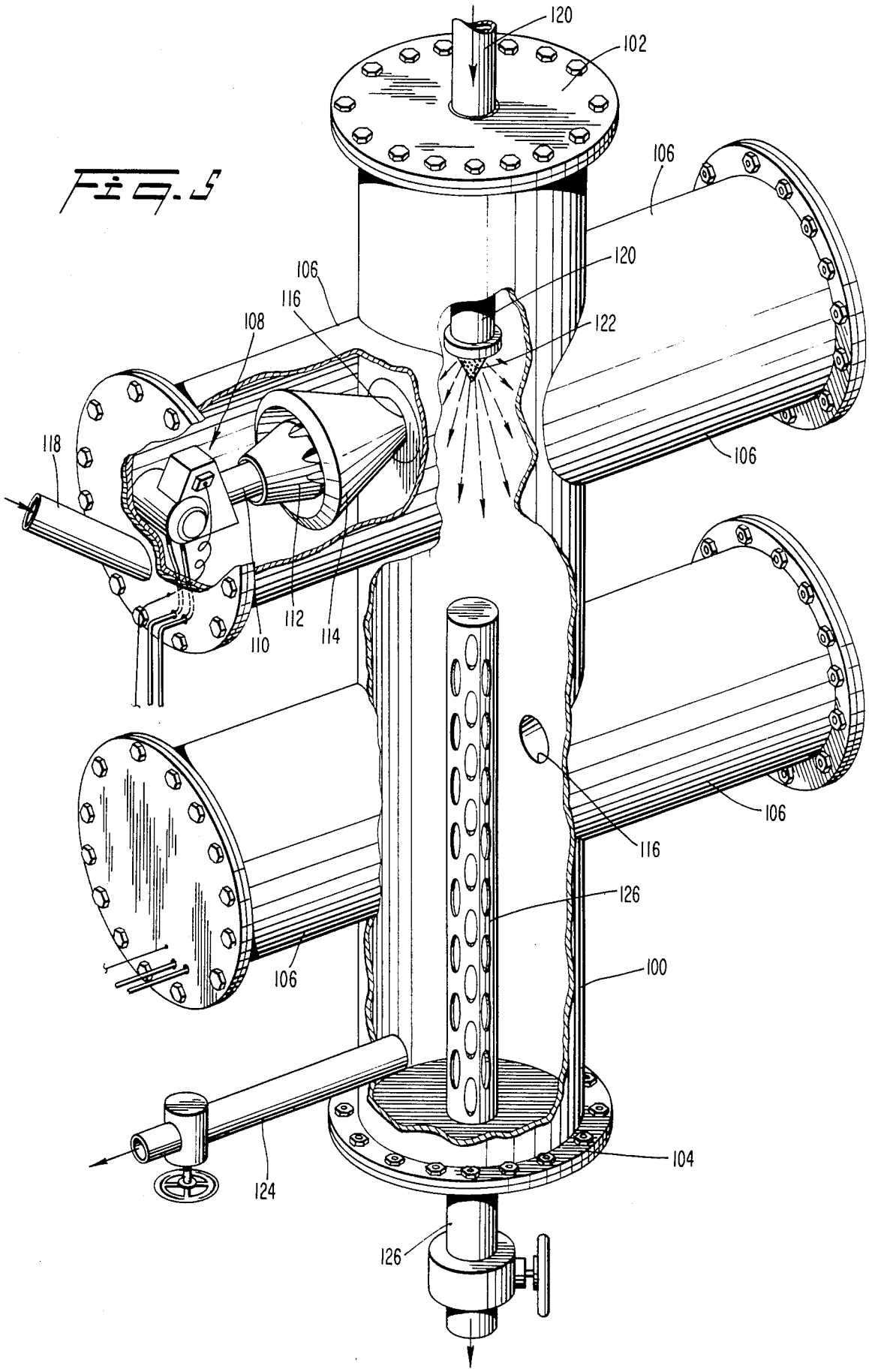
FIG. 5 is a perspective view, partially broken away of a second embodiment of the present invention.

A second preferred embodiment of the invention is depicted in FIGS. 5 and 6, and operates in accordance with Maxwell's Law. On the basis of Maxwell's Law it has been proven that compressed air blown tangentially into the side of a tube so as to swirl within the tube will simultaneously produce cold air at the center of the vortex and hot air at the outer circumference of the vortex. Applicant is not aware, however, of any practical applications of Maxwell's Law, except for the present invention.

In FIG. 5, there is depicted a vertical cylindrical vessel 100 which is closed-off at its upper and lower ends by end plates 102, 104. Extending radially from the vessel is a plurality of identical burner chambers 106 in which is disposed a burner 108. A flame outlet of the burner comprises a cylindrical tube 110 and a frusto-conical flame shield 112 disposed at the end of the tube 110 such that, as in the earlier described embodiment, the larger cross-section of the flame shield is situated downstream of the smaller cross-section.

Covering the outlet of the flame shield is a venturi cone 114 having a small diameter end 116 communicating with the interior of the vessel 100. Compressed air is introduced into the burner chamber through an air inlet duct 118 and travels into the vessel through a radial space between the outlet of the flame shield 112 and the inside surface of the venturi cone 114. In so doing, the air is heated and increases in velocity as it travels from the larger cross-section to the smaller cross-section of the venturi cone.

The outlet of the venturi cone is offset relative to the longitudinal center of the vessel, whereby the pressurized air swirls within the vessel. If desired, deflector vanes could be positioned at the venturi outlet to promote swirling. If more than one of the burner chambers 106 are employed, they are all oriented so as to create a swirling action in the same direction relative to the longitudinal axis of the vessel. In accordance with Maxwell's Law, the temperature of the air will increase sharply in the radially outward direction, i.e., the swirling air at the outer portion of the vortex will be hotter than at the inner portion. The temperatures involved will vary in accordance with a number of factors including the number of the burner chambers 106 which are employed.

A water conduit 120 extends into the vessel through the upper end plate 102 and terminates in a spray nozzle 122 which emits a water spray into the swirling air. Accordingly, the water is instantly vaporized and the resulting hot steam is exhausted through a steam outlet 124. The cooler steam is exhausted through a perforated pipe 126 located coaxially at a lower end of the vessel, i.e., preferably extending along about two-thirds of the height of the vessel.

Since the velocity of the air is increased by the venturi 116, sufficient oxygen is drawn-in to burn all of the burner fuel and create super heated gases. Depending upon the number of burner units which are employed, the temperature of the steam exhausted through the steam outlet 124 may exceed 10,000° F.; cold steam exhausted through the cold steam outlet 126 may be as cool as 170° F. Due to the high temperatures involved, the vessel should be lined with a ceramic lining.

The temperature of the steam can be controlled in order to conform to the intended use. With regard to superheated steam, such uses might include steam cleaning, thawing of frozen pipes, melting or smelting of ferrous and non-ferrous materials; the melting of rock, sand and clay for use as building materials; and destroying contaminates in soils, oils, water, or other types of liquid or solids in which other kinds of heat might create flashpoints.

If either of the outlets 124, 126 is closed, the hotter and cooler steams will be mixed and will exit the unblocked outlet with a cooler temperature similar to that obtained with the embodiment described in connection with FIGS. 1-4.

By closing-off the water conduit 120, the apparatus could continue to operate to produce hot and cold air streams for purging water lines, sewer lines, among other uses. By introducing sand into the vessel instead of water, the apparatus could be employed in hot or cold sand blasting operations.

A third preferred embodiment of the invention is depicted in FIG. 7 wherein the temperature of the steam exhausted from the embodiment disclosed in connection with FIGS. 1-4 can be increased by exhausting the cooler steam through an apertured conduit 200 which is coaxial with the water pipe 62. That is, since the hot, pressurized air from the third turbulator unit 24 is swirling, there will occur, according to Maxwell's Law, hotter steam at the other circumference of the vortex and cooler steam at the center of the vortex. By exhausting the cooler steam through the conduit 200, the temperature of the steam exhausted through the outlet 28 will be higher.

Although the present invention has been described in connection with preferred embodiments thereof, will be appreciated by those skilled in the art that modifications, substitutions, additions, and deletions not specifically described, may be made without departing from the spirit and scope of the invention as defined in the appended claims.

What is claimed is:

1. An apparatus for producing steam, comprising:

a vessel defining a longitudinal axis and opposing front and rear longitudinal ends, an inlet disposed adjacent said front end and an outlet disposed adjacent said rear end, means for introducing compressed air into said inlet such that the air travels from said inlet toward said outlet, means for inducing a continuous swirling motion of the air about said longitudinal axis as it travels, heating means for heating the air, sprayer means for spraying water into said swirling heated air such that the water becomes vaporized and entrained in the air flow and exits as steam through said outlet.

2. Apparatus according to claim 1, including a deflector plate disposed in said vessel upstream of said outlet and said sprayer means and being open at its outer periphery to conduct the swirling air therethrough, said heating means arranged to heat said deflector plate, said sprayer means arranged to spray the water against a backside of said deflector plate such that the water becomes vaporized upon contacting said deflector plate and is deflected rearwardly into the air flow.

3. Apparatus according to claim 2, wherein said swirl inducing means comprises at least one turbulator plate situated upstream of said deflector plate and including an outer periphery having vanes oriented to induce swirling of the air in a common direction.

4. Apparatus according to claim 3, wherein said swirl inducing means comprises vanes disposed at an outer periphery of said deflector plate for inducing a swirling motion of the air in the same direction as said vanes of said turbulator plate.

5. Apparatus according to claim 4, wherein said vessel is generally cylindrical and is closed at its ends by front and rear end plates, said at least one turbulator plate comprising first and second turbulator plates, said turbulator plates and said vanes on said deflector plate inducing a swirling motion of air in a common direction, said turbulator plate spaced rearwardly from said front end plate to define therewith a first chamber, the compressed air being introduced into said first chamber, said second turbulator plate spaced rearwardly from said first turbulator plate and forwardly from said deflector plate, said first and second turbulator plates defining a second chamber therebetween, and said second turbulator plate and said deflector plate defining a third chamber therebetween, said deflector plate and said rear end plate defining a fourth chamber therebetween, said heating means comprising a fuel burner located in said first chamber and including an outlet directed toward said deflector plate and passing through said first and second turbulator plates to direct a flame from said burner into said third chamber and toward said deflector plate to heat the air and said deflector plate.

6. Apparatus according to claim 2, wherein said swirl inducing means comprises vanes disposed at an outer periphery of said deflector plate.

7. Apparatus according to claim 2, wherein said heating means comprises a burner for introducing a flame into said vessel upstream of said deflector plate and into contact with the air.

8. Apparatus according to claim 7, wherein said burner is arranged to direct the flame against a front side of said deflector plate to heat same.

9. Apparatus according to claim 2, wherein said spraying means comprises a water conduit and a nozzle communicating with said water conduit.

10. Apparatus according to claim 2, wherein said longitudinal axis of said vessel is horizontal.

11. Apparatus according to claim 2, wherein said outlet is disposed adjacent an outer periphery of said vessel, and an additional outlet extending generally centrally of said vessel through an end of said vessel such that hotter steam exits through said first-named outlet and cooler steam exits through said additional outlet.

12. Apparatus according to claim 1, wherein said outlet is disposed adjacent an outer periphery of said vessel, and an additional outlet extending generally centrally of said vessel through an end of said vessel such that hotter steam exits through said first-named outlet and cooler steam exits through said additional outlet.

13. Apparatus for producing steam comprising:

a vessel defining a longitudinal axis and having an inlet and first and second outlets spaced longitudinally rearwardly from said inlet, means for introducing compressed air through said inlet such that the air travels from said inlet toward said outlets, means for heating the air, means for inducing a swirling motion to the air, means for introducing water into the vessel which vaporizes in response to contacting the heated swirling air to form a swirling steam flow characterized by hot steam at an outer periphery of the steam flow and cooler steam at the center of the steam flow, said first outlet disposed at an outer periphery of the vessel to exhaust the hot steam, and said second outlet disposed centrally of said vessel to exhaust the cooler steam.

14. Apparatus according to claim 13, wherein said inlet comprises a venturi cone arranged such that air entering said inlet passes through a gradually decreasing cross-section of said cone and increases in velocity.

15. Apparatus according to claim 14 including at least one burner chamber connected to said vessel and surrounding said inlet, said heating means comprising a burner disposed in said burner chamber for emitting a flame into a wide cross-sectional end of said venturi cone, said air introducing means introducing pressurized air into said burner chamber which passes into said wide cross-sectional end of said venturi cone.

16. Apparatus according to claim 15, wherein said swirl inducing means comprises an offset relationship between said inlet and the longitudinal axis of said vessel.

17. Apparatus according to claim 15, wherein there are a plurality of said burner chambers.

18. Apparatus according to claim 15, wherein said vessel is cylindrical and is closed-off at its ends by end plates, said second outlet comprising a perforated conduit extending through one of said end plates coaxially with said vessel.

19. Apparatus according to claim 18, wherein said longitudinal axis of said vessel is vertically oriented.

20. A method of producing steam comprising the steps of:

introducing pressurized air into one end of a vessel which defines a longitudinal axis and causing the air to continuously swirl about said axis while traveling toward a longitudinally opposite end of the vessel, heating both the air and a front side of a deflector plate disposed in the path of the air, causing the air to flow past an outer periphery of said deflector plate while continuing to swirl, spraying water against a backside of said deflector plate such that the water is vaporized as steam and is entrained in the air flow, and exhausting the steam downstream of said deflector plate.

21. A method according to claim 20 including the step of exhausting hotter steam from an outer periphery of the vessel separately from cooler steam which is exhausted from the center of the vessel.

22. A method of producing steam comprising the steps of:

introducing pressurized air into one end of a vessel and causing the air to swirl while traveling toward a longitudinally opposing end of said vessel, heating the air, introducing water into the heated swirling air to cause the water to become vaporized as a swirling steam flow wherein hot steam is disposed at an outer periphery of the swirling steam flow, and cooler steam is disposed at the center of the swirling steam flow, and exhausting the hot steam flow separately from the cooler steam flow.

* * * * *